343-756 SR
2/20/79 OR 4,141,013

United States Patent [19]
Crail et al.

[11] 4,141,013
[45] Feb. 20, 1979

[54] INTEGRATED CIRCULARLY POLARIZED HORN ANTENNA

[75] Inventors: Timothy A. Crail; Mon N. Wong, both of Culver City, Calif.

[73] Assignee: Hughes Aircraft Company, Culver City, Calif.

[21] Appl. No.: 726,336

[22] Filed: Sep. 24, 1976

[51] Int. Cl.[2] ..... H01Q 13/02; H01Q 15/08
[52] U.S. Cl. ..... 343/756; 343/786
[58] Field of Search ..... 343/786, 783, 756; 333/98, 21 A

[56] References Cited

U.S. PATENT DOCUMENTS

| | | | |
|---|---|---|---|
| 2,933,731 | 4/1960 | Foster et al. | 343/786 |
| 3,201,717 | 8/1965 | Grosbois et al. | 343/756 |
| 3,624,655 | 11/1971 | Sato et al. | 343/756 |
| 3,668,567 | 6/1972 | Rosen | 343/756 |
| 3,680,145 | 7/1972 | Beguin | 343/786 |
| 3,955,202 | 5/1976 | Young | 343/786 |

*Primary Examiner*—Alfred E. Smith
*Assistant Examiner*—David K. Moore
*Attorney, Agent, or Firm*—R. A. Cardenas; John Holtrichter, Jr.; W. H. MacAllister

[57] ABSTRACT

A horn antenna is disclosed having a built-in circular polarizer and a cross polarization attenuator. A square-apertured horn antenna has a plurality of pairs of conductive fins disposed along opposite edges of the horn interior. The individual fins are separated from each other by approximately one-fourth wavelength. The fins are at a 45 degree angle to that linear wave and react with that linear wave by imparting a circular rotation to that wave as the wave propagates past each pair of fins. A stepped attenuator is mounted in the input section to the horn antenna perpendicular to the linear input wave. The attenuator substantially absorbs cross-polarized signals whether reflected from the aperture of the horn or provided by the incoming signal.

7 Claims, 7 Drawing Figures

Fig. 2.
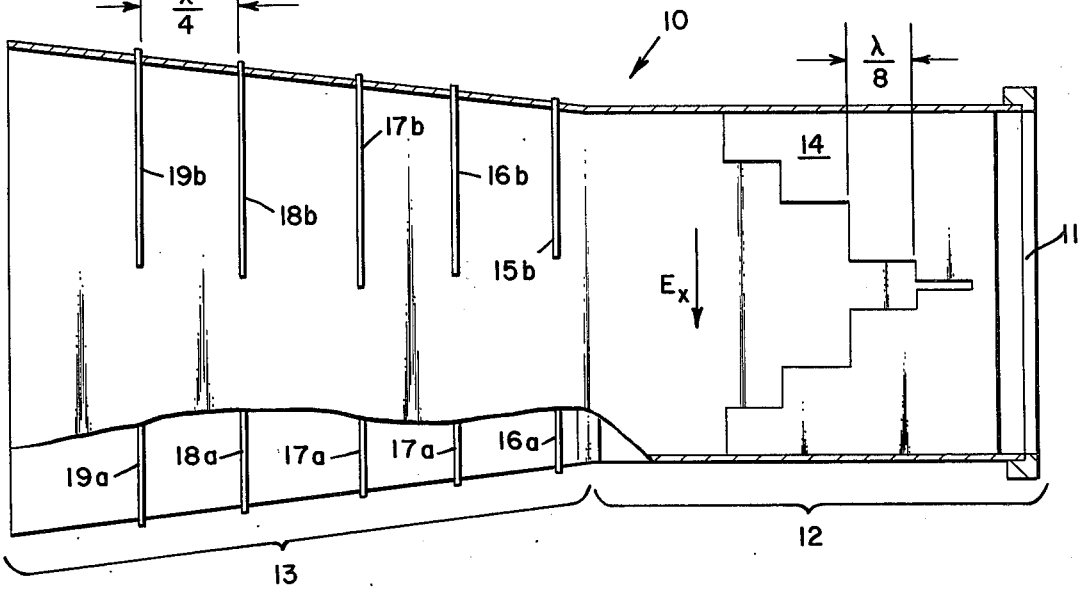
Fig. 3.
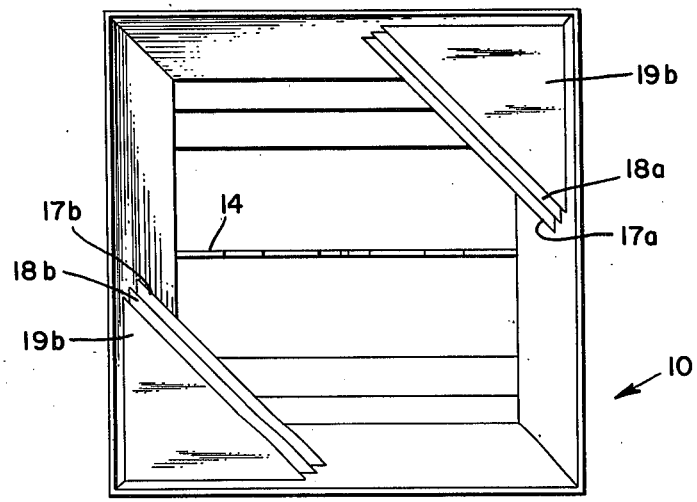
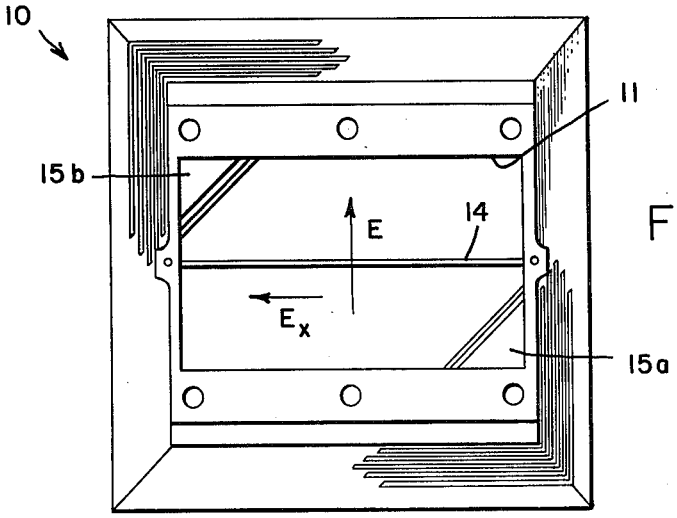
Fig. 4.

INTEGRATED CIRCULARLY POLARIZED HORN ANTENNA

BACKGROUND OF THE INVENTION

1. Field of the Invention

The invention relates generally to antennas and in particular relates to horn antennas utilizing circularly polarized signals.

2. Prior Art

Horn antennas are generally known in the prior art, so too, are circular polarizers and cross-polarization attenuators. These microwave components have, until now, been separate entities which are serially connected together. The horn antennas which are used in satellite communications applications, for example, may be conical, square or have other equal multi-sided configurations. Heretofore, horn antennas merely provided the function of radiating or receiving the circularly polarized energy.

The circular polarizer section, which is usually mounted immediately adjacent to the horn antenna, only provides a rotation or circular polarization to a linearly polarized wave which is to be transmitted. The polarizers have generally consisted of a quarter-wave plate or 90 degree phase shifter placed in a cylindrical or square waveguide section. The quarter-wave plate may be made of a dielectric or conductive material. Another method of providing circular polarization is by utilizing fins inside a cylindrical or square waveguide section.

Attenuators are also generally known in the prior art for reducing the amplitude of cross-polarized waves in an antenna. The attenuators are usually connected between the polarizer section and a diplexing network for transmitting and receiving the microwave energy. The prior art attenuators include a waveguide section having a wedge-shaped resistive member mounted therein. The apex of the wedge is directed at the aperture of the horn antenna, i.e., the direction from which the unwanted energy is coming, and the plane of the wedge is parallel to the E vector of the cross-polarized linear wave. The wedge thusly oriented is transparent to a perpendicular input wave but is resistive to a parallel cross-polarized wave thereby attenuating the cross-polarized signals. Other methods of reducing the cross component of a linear signal include use of the magic "tee" or hybrid circuitry.

Another method of producing circularly polarized signals from a linear wave is to place an external screen or grating directly in front of the horn aperture which is radiating linear signals. The screen or grating is composed of a series of conductive strips arranged at a 45 degree angle to the direction of linear waves. The strips so arranged provide both right and left hand circular polarization to two orthogonal signals being radiated by the horn antenna. With such an arrangement an attenuator cannot be used because the radiated or received signals at the antenna will be linear and an attenuator as described above would completely eliminate one of the signals.

One of the principal drawbacks of having a system as above described i.e., a separate horn antenna, a separate circular polarizer and a separate attenuator is quite obviously the length and weight of such a combination. The weight and length of such prior art systems make them impractical for satellite communications applications. For example, a horn antenna used in a communications satellite broadcasts and receives 3.7 to 4.2 GHz. is approximately 4" in length. The polarizer section is approximately 8" in length and the attentuator section is 10" long. The transition waveguide section from the transmitter receiver to the input of the attenuator section is approximately 3" long. Thus, the entire antenna group is about 25" long and weighs approximately one pound. It is apparent that the use of separate microwave antenna components requires volume and adds greatly undesired weight to a communications satellite which is being placed into orbit around the earth.

OBJECTS AND SUMMARY OF THE INVENTION

Accordingly, it is an object of the present invention to provide a simplified, reliable and compact antenna.

It is another object of the present invention to provide an antenna utilizing circularly polarized waves.

It is still another object of the present invention to provide an antenna for absorbing signals which are orthogonal to the linear input signal to the antenna.

It is yet another object of the present invention to provide a high efficiency horn antenna system.

In accordance with the above objects a horn antenna having a predetermined angle of flare includes input means for receiving a linearly polarized wave. The horn antenna includes reactive iris means disposed within said horn antenna for generating a circularly polarized wave in response to said linearly polarized wave. In a second embodiment the input means include stepped attenuator means for absorbing cross-polarized waves.

BRIEF DESCRIPTION OF THE DRAWINGS

FIG. 2 is a longitudinal sectional view of the embodiment according to FIG. 1.

FIG. 3 is an end view at the aperture of the horn antenna according to the embodiment of FIG. 1.

FIG. 4 is an end view of the input section of the present invention according to FIG. 1.

DETAILED DESCRIPTION OF THE DRAWINGS

Figure 1:
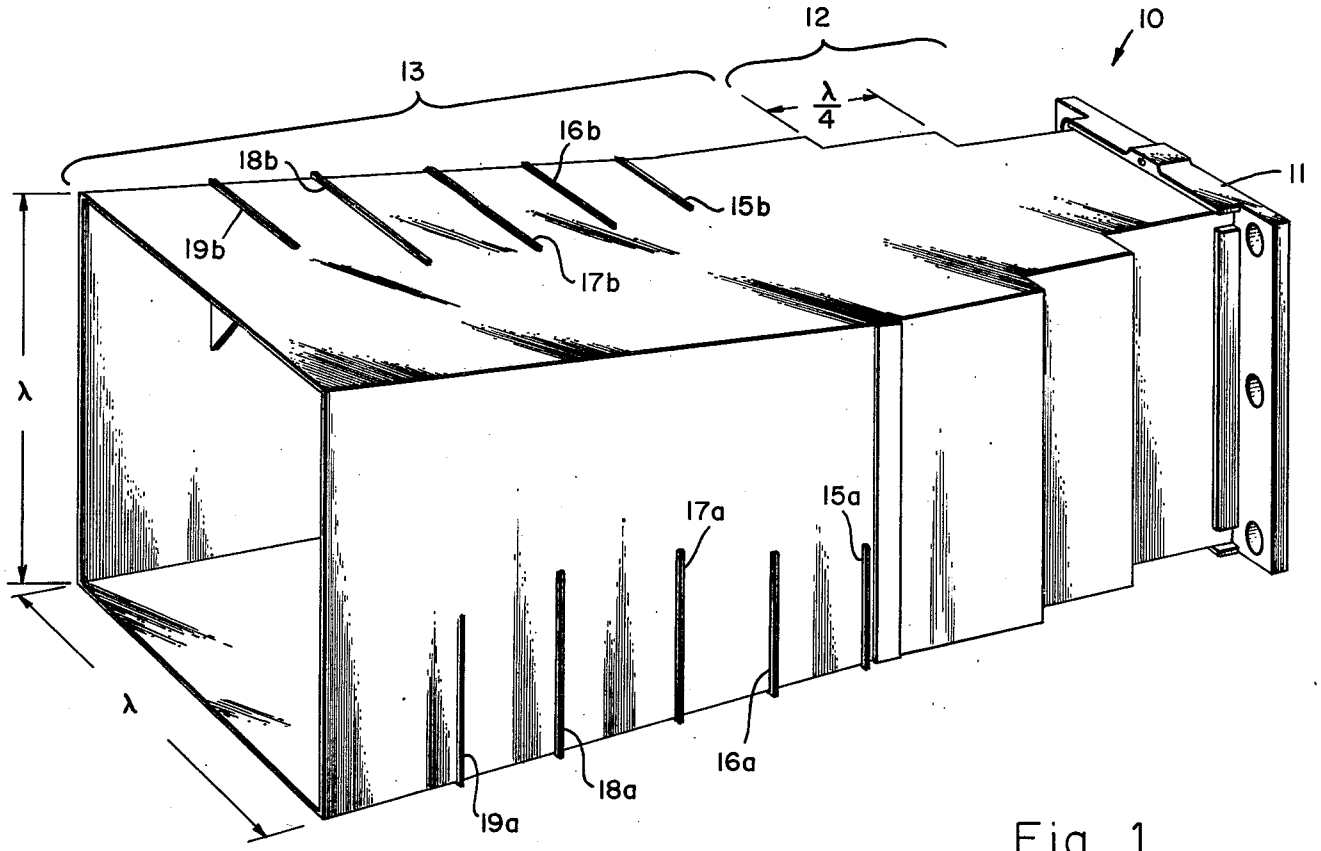
FIG. 1 is a perspective view of one embodiment of the present invention.

Referring now to FIG. 1, an antenna 10 includes an input port 11 connected to a transition section 12 which in turn is connected to a flared antenna body. A step attentuator plate 14 (not shown) is mounted within the transition section 12. Five pairs of reactive irises shown here as fin pairs 15*a* & *b*, 16*a* & *b*, 17*a* & *b*, 18*a* & *b* and 19*a* & *b* are disposed along opposite edges of the flared antenna body 13. These fins comprise a circular polarizer 20.

The input port 11 receives a linearly polarized signal from the transmitter network and alternately provides a linearly polarized signal to the receiver network through a diplexer network. The input port 11 is rectangular in shape for connecting with the rectangular waveguide from the diplexer. The input port may also be square or circular in other applications. The transition section 12 shown here as a housing having stepped portions provides a function similar to that of a step-up transformer for matching the impedance between the horn 13 and the input port 11. Each step of the transition section is one-quarter wavelength long for making a smooth transition from the rectangular input port of the square horn 13. An antenna for transmitting and receiving in the 3.7 to 4.2 GHz bandwidth has an input port with dimensions of 1.14 inches by 2.29 inches. If a circular or square input port is utilized, a transition section such as section 12 is unecessary. The horn 13 is square in cross-section and each side is 2.29 inches with a flare angle between opposing sides of approximately 14°. Alternately, the horn 13 may be conical or any other equal multisided cross-section.

Referring now to FIG. 2, the longitudinal section view of the antenna 10, according to FIG. 1, illustrates in greater detail the inventive features of the present invention. It may be seen that the attenuator plate 14 is mounted in the area of the transition section 12. The attenuator plate 14 is flat and approximately 0.032 inches thick. The edge of the plate facing the input port 11 is straight while the edge facing the aperture end of the antenna 10 has four pairs of steps for impedance matching and gradual absorption of the cross-polarized signal impinging upon the plate 14. Each step is approximately one-eighth of a wavelength (one-eighth λ) long in the direction of wave propagation. A greater or lesser number of steps may be provided in the attenuator plate 14 depending on the impedance matching required and the degree of attenuation that is desired. The total length of the attenuator plate 14 along the direction of wave propagation is less than one wavelength. The plate 14 may have a fiberglass base material which is coated on one side for providing electrical conduction. The conductive material may be vacuum deposited in such a way that the coating is a very poor conductor so as to present a high resistance to a wave that is parallel to the plane of the plate. The incoming parallel wave sees the first pair of steps and part of the energy in that wave is converted to RF current which flows on the surface of the metalized attenuator plate 14. But, since the metalizing provides such a poor conductor, the RF currents experience a high resistance causing the energy to be converted into heat which can then be dissipated by the sides of the antenna 10. As the wave propagates further into the attenuator plate 14, more and more energy is absorbed without a significant amount of reflected energy being sent into the flared portion of the antenna 10. As the cross-polarized wave passes over the attenuator plate 14, it encounters a portion of the transition of section 12 which is below the cut-off frequency for the cross-polarized wave. At this point, the wave is reflected back across the attenuator plate 14 which further attenuates the wave passing over it. It is therefore apparent that the cross-polarized wave is being twice attenuated by one small length of attenuator plate. In experiments it was found that without a cut-off section at one end of the attentuator plate reflected energy was measured at the aperture of the horn antenna 13. And, with the cut-off section at one side of the attenuator plate 14, the reflected cross-polarized energy was substantially reduced.

With reference to the circular polarizer 20 within the antenna 13, each pair of irises or conductive fins imparts a rotation or circular polarization to a linear wave propagating past each pair. As will be readily apparent below, the edges of the fins are at a 45° angle to the E vector of the incoming linear wave and having such a disturbance in the path of a propagating wave, one of the component vectors of the linear wave is delayed while the other component is advanced. The fins are mounted on one edge of the horn 13 and are placed approximately one-quarter wavelength (one-fourth λ) apart. From the drawing, it is apparent that the spacing between some fins varies and this is due to other parameters such as the flare angle of the horn 13 and the impedance matching requirements. The amount that each fin protrudes into the horn is determined by the frequencies, the flare angle of the horn and the impedance. The first pair of fins, 15*a* and *b*, is placed in close proximity to the input to the horn 13 and the last fin is placed about one-quarter wavelength from the aperture. The number of fins used depends upon the particular bandwidth of the signals being utilized. For example, for a very narrow bandwidth, only one pair of fins may be required while for a bandwidth of 3.7 to 4.2 GHz, five pair of fins are sufficient. As will be described in greater detail below, each pair of fins delays the $E_1$ component and advances $E_2$ component of a linear wave at a particular band of frequencies. Consequently, each pair of fins is imparting circular polarization to selected frequencies. Other reactive elements may be used within the horn 13 for generating CP waves, such as a quarter-wave plate, a purely inductive element or a purely capacitive element.

Referring now to FIG. 3, the antenna is viewed from the aperture end which illustrates the pairs of fins protruding into the horn 13. The amount that the fins protrude, as mentioned above, depends upon several parameters. For instance, a fewer number of fins may be used but these must protrude further into the horn while a greater number of fins may be used which protrude less. The configuration of the individual fins is not limited to a triangular shape but may have other forms which provide the proper circular polarization for the frequencies being utilized.

Referring now briefly to FIG. 4, the antenna 10 is viewed from the input end of the transition section 12. The linear input wave is identified by the vector E. As the E vector propagates into the transition section 12, the attenuator plate 14 is transparent because that plate is at right angles to the E vector. A cross-polarized signal, such as vector $E_X$, induces an RF current in the attenuator 14 which experiences a high resistance which converts the current into heat which is in turn dissipated by the sides of the antenna 10.

Figure 5:
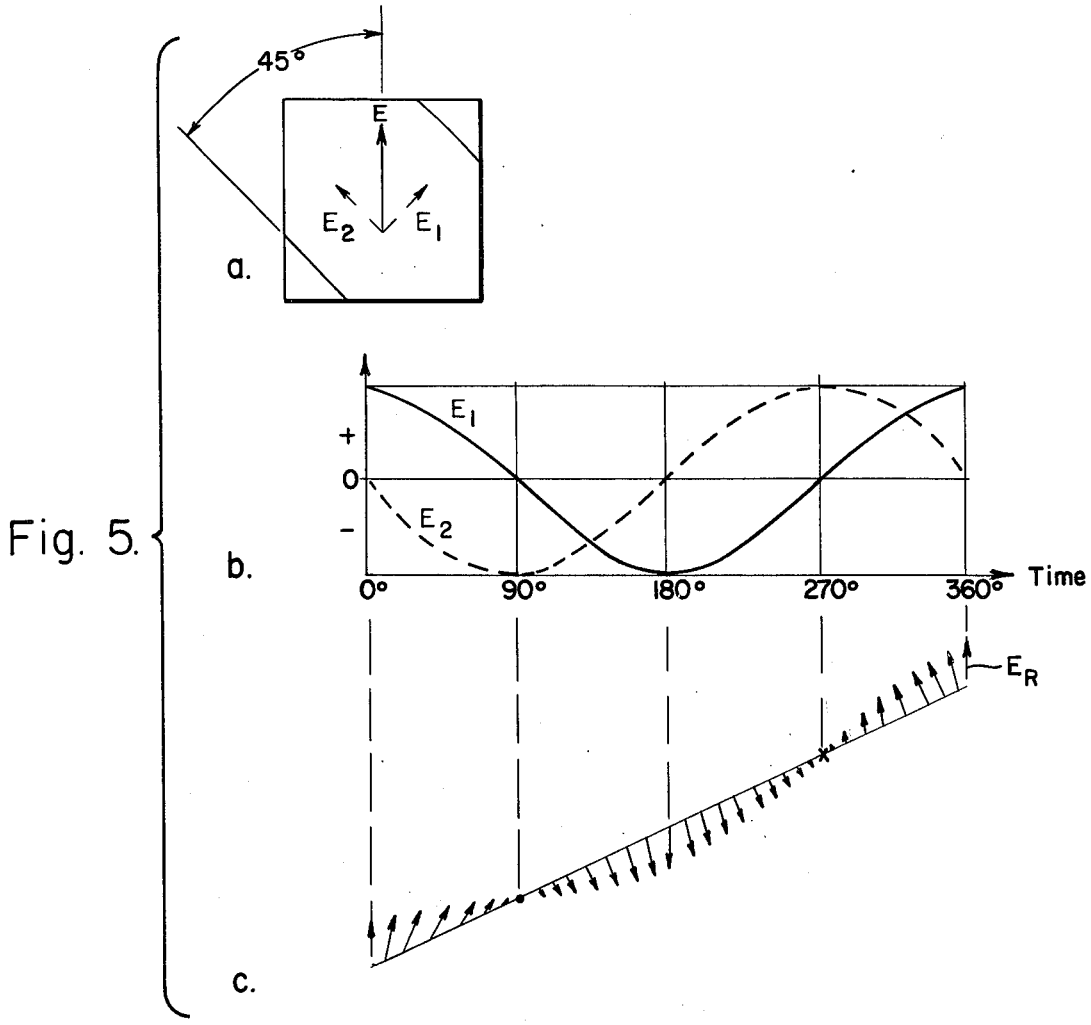
FIG. 5*a* is a vector diagram of the vector components of a circularly polarized wave propagating through an antenna according to the invention.
FIG. 5*b* is a graph illustrating the phase of the vector components.
FIG. 5*c* is a vector diagram illustrating a right-hand circularly polarized wave.

Referring briefly to FIG. 5*a*, the E vector propagating through the polarizer 20 is decomposed into its component vectors $E_1$ and $E_2$. The E vector is oriented at 45° to the edge of the fin or iris. FIG. 5*b* illustrates the amplitude of both component vectors $E_1$ and $E_2$ with respect to time as a wave is radiated from the aperture of the antenna 10. At zero degrees, vector $E_2$ is advanced as a result of reaction of the linear wave with the polarizer 20 and $E_1$ is delayed. Thus, at zero degrees, the vector $E_1$ is delayed with respect to vector $E_2$ which is shifted as a result of the action of the iris within the horn 13.

Referring now to FIG. 5*c*, the resultant vector $E_R$ which is radiated by the antenna 10 is made up of components $E_1$ and $E_2$ and it may be seen to rotate as right-hand circular polarization with respect to time. A left-hand circularly polarized signal may be generated by providing a linear input signal which is perpendicular to the input signal heretofore described.

Figure 6:
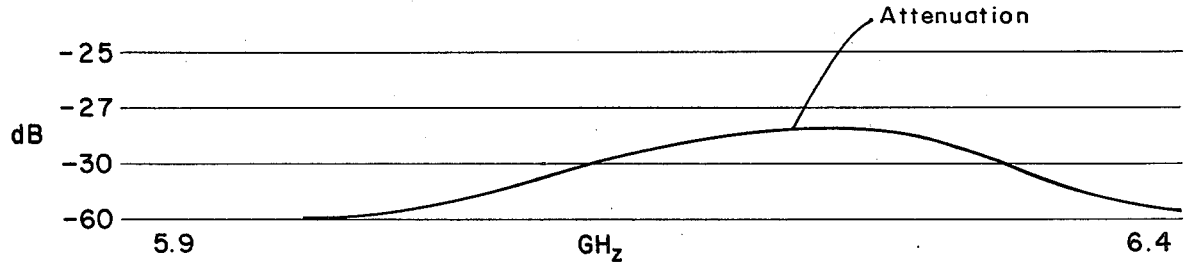
FIG. 6 is a graph diagram illustrating the attenuation of a stepped attenuator.
Figure 7:
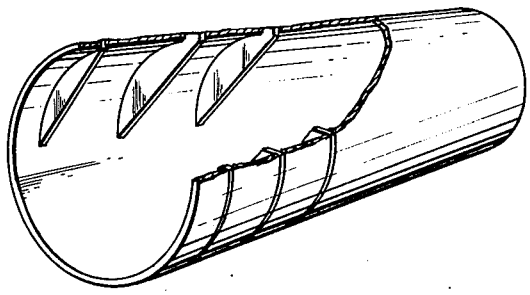
FIG. 7 is a perspective view of the present invention utilizing a conical horn antenna.

Referring now to FIG. 6, the attenuation of a stepped attenuator plate 14 is illustrated in decibels with respect to frequency in having a bandwidth of 5.9 GHz to 6.4 GHz. An attenuator plate for the above-cited bandwidth has a length, along the direction of wave propagation, of 1.5 inches or approximately one wavelength. It is obvious from the test results illustrated in the present graph that a small attenuator plate 14 provides a substantial amount of attenuation within the designed frequency band. As mentioned above, this is a result of the cross-polarized wave passing over the attenuator plate a first time being attenuated, being reflected and being attenuated a second time as the reflected wave propagates across the attenuator plate 14. In testing that was carried on without a cut-off at one side of the attenuator plate, it was found that the attenuation of a plate 14 was approximately half of what is seen in the present graph. If an antenna according to the principles of the present invention generates both right and left-hand circularly polarized waves, the attenuator plate 14 may not be used since it would absorb one of the cross-polarized signals.

In summary, as is apparent from the preceding description and drawings of the present invention, a compact, efficient, and lightweight horn antenna structure has been disclosed. A horn antenna system for use in a band of 3.7 to 4.2 GHz has been constructed, tested and installed in commercial use in a communications satellite. As a result of combining a horn antenna, a polarizer, and an attenuator savings in valuable weight and volume have been achieved. The antenna weighs approximately 5 ounces and is about 6 inches in length. The use of the square aperture allows a plurality of square horns to be packed together in a tightly-knit array which as a consequence utilizes all the space available which would be lost if an array of conical horns was used instead. The increased area of a square horn over a conical horn allows a greater output power to be provided by the antenna.

Although the present invention has been shown and described with reference to a particular embodiment, nevertheless, various changes and modifications obvious to one skilled in the art to which the invention pertains are deemed within the purview of the invention.

What is claimed is:

1. A compact, lightweight and improved integrated antenna comprising:

input means for receiving a first linear signal which has a vector in a first plane and propagating in a direction normal to the first plane;

horn means coupled to said input means and having a predetermined angle of flare for receiving the linear input signal and propagating the signal therethrough and for providing output signals being circularly polarized waves; and a plurality of pairs of conductive fins mounted within said horn means, each pair of conductive fins being mounted 180° apart, said fins being mounted at 45° to the direction of the vector for reacting with the linear input signal propagating therethrough and generating circularly polarized output signals.

2. A compact, lightweight and improved integrated antenna comprising input means for receiving a first linear signal which has a vector in a first plane and propagating in a direction normal to the first plane;

horn means coupled to said input means including a stepped transformer and having a predetermined angle of flare for receiving the linear input signal and propagating the signal therethrough and for providing output signals being circularly polarized waves; and a plurality of pairs of conductive fins mounted within said horn means, each pair of conductive fins being mounted 180° apart, and being in a plane normal to the direction of propagation for reacting with the linear input signal propagating therethrough and generating circularly polarized output signals.

3. A compact, lightweight and improved integrated antenna, comprising:

stepped transformer input means for receiving a first linear signal wave which has an E vector in a first plane and which propagates in a direction normal to the first plane;

stepped attenuator means disposed within said stepped transformer input means for providing gradual attenuation to a second wave which has a vector perpendicular to said E vector, said stepped attenuator means having a plurality of conductive steps;

horn means coupled to said input means, said horn means having a predetermined angle of flare for receiving the linear input signal wave and propagating it therethrough and for providing circularly polarized output waves; and iris means disposed within said horn means for reacting with the linear input signal propagating therethrough and generating circularly polarized output signals.

4. The invention according to claim 3, wherein:

said horn means has a square cross section; and said stepped transformer is a waveguide having first and second ends, said first end being rectangular, said second end being square, said waveguide having a predetermined number of steps between said first and second ends.

5. The invention according to claim 4 wherein the steps of said stepped transformer are one-fourth wavelength long.

6. The invention according to claim 3 further comprising:

said stepped attenuator being a film of conductive material being a poor conductor for inducing currents in response to a second wave having a resultant vector being perpendicular to the vector of said first wave.

7. The invention according to claim 3 wherein said plurality of conductive steps are oriented such that a wave propagating in the opposite direction to said first wave is attenuated in an increasing manner.

* * * * *